United States Patent [19]

Maresch

[11] Patent Number: 4,865,502

[45] Date of Patent: Sep. 12, 1989

[54] FASTENING MEANS AND METHOD FOR THE USE OF POROUS MATERIALS

[76] Inventor: Heinrich Maresch, 66, Hyttavägen, S-618-00, Kolmården, Sweden

[21] Appl. No.: 119,276

[22] Filed: Nov. 9, 1987

Related U.S. Application Data

[63] Continuation of Ser. No. 876,858, filed as PCT SE85/00370 on Sep. 26, 1985, published as WO86/02130 on Apr. 10, 1986, abandoned.

[30] Foreign Application Priority Data

Sep. 28, 1984 [SE] Sweden ..... 8404854

[51] Int. Cl.[4] ..... F16B 15/04

[52] U.S. Cl. ..... 411/358; 29/524; 52/309.7; 403/280; 403/281; 411/477

[58] Field of Search ..... 411/15, 21, 22, 23, 411/54, 439, 446, 448, 449, 478, 479, 501, 502, 503, 447, 358, 359, 477; 24/703, 704; 29/503, 524, 525; 403/279, 280, 281, 282; 52/309.7

[56] References Cited

U.S. PATENT DOCUMENTS

| | | | |
|---|---|---|---|
| 886,515 | 5/1908 | Jude | 403/281 X |
| 958,127 | 5/1910 | Hovrod | 411/21 X |
| 1,121,484 | 12/1914 | Crites | 411/358 |
| 2,035,885 | 3/1936 | Hojnowski | 411/358 |
| 2,137,688 | 11/1938 | Hojnowski | 411/358 |
| 2,550,060 | 4/1951 | Gisondi | 411/448 |
| 2,608,123 | 8/1952 | Israelson | 411/358 |
| 2,779,229 | 1/1957 | Jahn | 411/449 |
| 2,959,897 | 11/1960 | Baker | 411/478 X |
| 4,655,659 | 4/1987 | Leemke | 411/359 |

FOREIGN PATENT DOCUMENTS

| | | | |
|---|---|---|---|
| 90780 | 10/1983 | European Pat. Off. | 411/54 |
| 203046 | 10/1908 | Fed. Rep. of Germany | 411/359 |
| 422555 | 12/1925 | Fed. Rep. of Germany | 411/359 |
| 99134 | of 0000 | Fed. Rep. of Germany | 411/448 |
| 2250611 | 4/1973 | Fed. Rep. of Germany | 52/309.7 |
| 2611893 | 9/1977 | Fed. Rep. of Germany | 52/309.7 |
| 808989 | 9/1936 | France | 411/359 |
| 1551125 | 11/1968 | France | 411/447 |
| 13839 | of 1895 | United Kingdom | 411/358 |
| 1604613 | 12/1981 | United Kingdom | 405/259 |

*Primary Examiner*—Gary L. Smith
*Assistant Examiner*—Curtis B. Brueske
*Attorney, Agent, or Firm*—Cushman, Darby & Cushman

[57] ABSTRACT

A fastener for use in porous granular or other easily penetratable material includes as a first element a guide element in the form of a flat plate having opposite faces and at least one guide slot which is open along the opposite faces of the plate and which has an open end at an edge of the plate, the slot being at least partially curved along its length. The fastener also includes a material-gripping element in the form of a blade which has a width greater than the thickness of the plate and which is insertable into the slot, the blade having opposite sides which are engaged by and guided by opposite edges of the slot along the entire length of the blade when the blade is inserted into the slot. The blade is deformed by the edges of the slot so as to correspond to the shape of the slot.

10 Claims, 2 Drawing Sheets

FASTENING MEANS AND METHOD FOR THE USE OF POROUS MATERIALS

This is a continuation of application Ser. No. 876,858, filed as PCT SE85/00370 on Sep. 26, 1985, published as WO86/02130 on Apr. 10, 1986, now abandoned.

BACKGROUND OF THE INVENTION

This invention concerns method and means for fastening in porous materials as for instance cell plastic. (The term porous materials is here meant in a broad sense, covering also granulous and other easily penetratable materials.) Cell plastic materials as well as other porous materials have very good heat insulating properties and they have therefore been more and more used in the building technique. Pure sandwich constructions with a core of polyurethane cell plastic between two metal sheets are of great importance in connection with industry buildings. Constructions of this type, below called panels, have in particular with great success been used all over the world for freezing chambers, cold-storage rooms and cold-storage warehouses in the two latest decades.

Mostly the panels are provided with groove and tenon and appropriate seals. In buildings for freeze storage an unyieldable requirement is that the joint between the panels is sealed against diffusion. This is achieved by locking the panels together with a locking device giving a permanent compression of the sealing strips and thus a permanent sealing function.

The locking device usually comprises of two halves that have been placed centrically in the cell plastic core close to the edges of the panel. The placing demands great accuracy in order to secure on mounting that the lockhalves in adjacent panels have exactly coinciding positions. A small deviation means a loss of the locking possibility and presumably a discarding of that panel.

The panels are fabricated according to one method in rigid moulds or jigs, where surface material and locks are firmly held in their positions before the interior of the panels are filled by foam by the injection of chemicals. According to a second method, the panels are fabricated in a continuous process where all parts are fed through a double band press at the foaming process. In a third process each panel is glued together of metal and foam sheets.

A correct fastening or enclosure by foam of parts as for instance locks, is a troublesome and costly operation, in particular in continuous fabrication. Instead of directly fastening parts by surrounding them by foam, these can afterwards be mounted in the finished panel. A cavity is machined in the cell plastic core, the part is placed in the cavity and is foamed or glued in place.

The shape and construction of the locking halves varies, but the main principal for fastening in the foam is rigid load taking lateral flanges. When mounting panels it is connected with great difficulties to change the position of faulty lock halves or to mount additional locks.

A further possible fastening would of course be to use expanding bolts of known type, but these will, to start with, not give a very good grip and secondly the expansion might easily deform the panels.

SUMMARY OF THE INVENTION

The object of the invention is to achieve a fastening method and fastening means allowing rigid and sturdy fastening in cell plastic as well as other porous materials, coping with great loads in any direction, without causing any expansion.

It is also the object of the invention to provide a method and means for a rigid fastening of locks in panels.

The above objects are achieved by a fastening means with two parts, of which the first part is provided with a guide that on mounting forces the second part to follow a guide path that at least partly is curved. Possible external forces exerted on the first part are conveyed to the second part, which due to its curved shape will be very stiff. As a result the second part can be made as a very thin blade, which in turn means that it can be very easily bent when pushed along the curved guiding path cutting its own way into the material and secondly that a minimum of thermal bridging will result.

The invention makes it possible to introduce the fastening forces at any preferred depth in the material and furthermore a good grip can be achieved without any expanding forces at all.

BRIEF DESCRIPTION OF THE DRAWINGS

Further advantages of the invention and details will be apparent from the following description and in the drawings shown embodiments of the invention, the examples in no way limiting the scope of the invention. In the drawings

DETAILED DESCRIPTION

Figure 1:
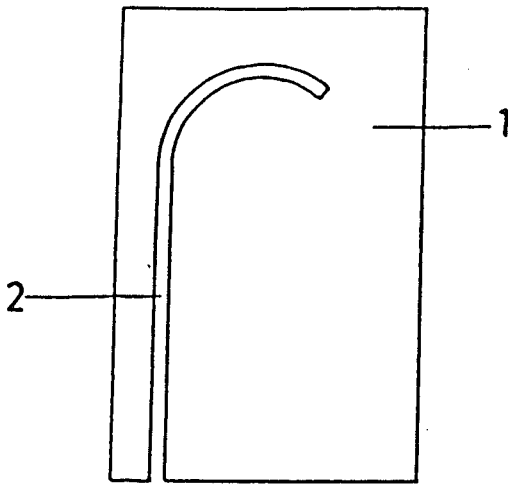
FIG. 1 shows a fastening means seen from above, FIG. 2 the fastening means of FIG. 1 in perspective and FIG. 3 a panel lock using a fastening means in accordance with the invention.
Figure 2:
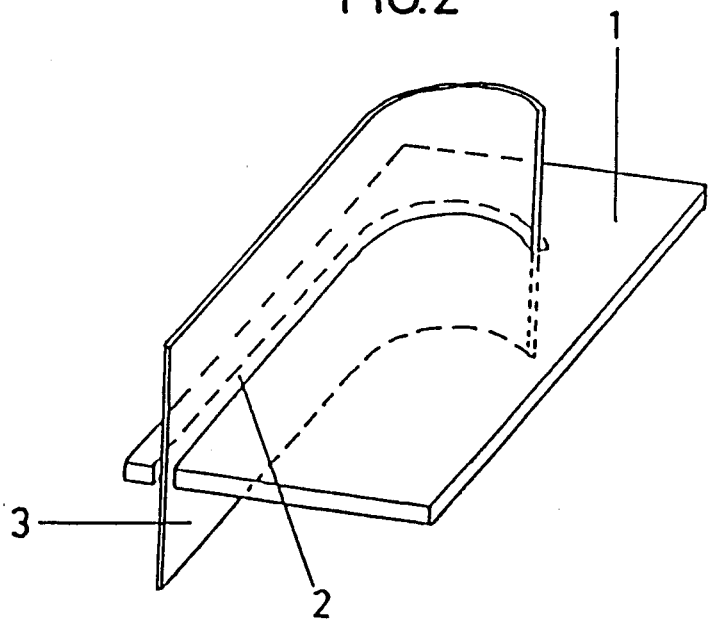

As can be seen from FIGS. 1 and 2 this fastening means includes a first part 1 in the shape of a plate provided with a slot 2 with a curved inner part. This plate 1 is, at the appropriate place, pushed into a prefabricated slot or opening or cuts its own way through the cellplastic. Thereafter a locking strip 3 of thin sheet material is pushed into the slot 2 cutting a conform path through the cell plastic until the strip reaches the end of the slot. In this position the plate is locked in all directions. By varying the dimensions of the plate 1 and the strip 3 and by varying the length and shape of the slot, the fastening means can be dimensioned for different objects, and the actual grip in the cell plastic can be at appropriate distance from the edge or surface of the material. The load is fastened to the plate. In FIG. 2 the fastening means of FIG. 1 is shown in perspective with an inserted metal strip 3. When the strip 3 is pushed into the slot it cuts its way through the cell plastic and with its curved inner end the metal strip 3 grips firmly into the cell plastic securing the plate 1 in the cell plastic. Due to the curvature the inner part of the strip will be very stiff and unyielding resulting in a very firm grip in the cell plastic. Normally the foam materials or cell plastic will exert sufficient friction on the strip 3 to retain this in its gripping position. Auxillary locking means may, however, be provided locking the strip in its inserted position.

Figure 3:
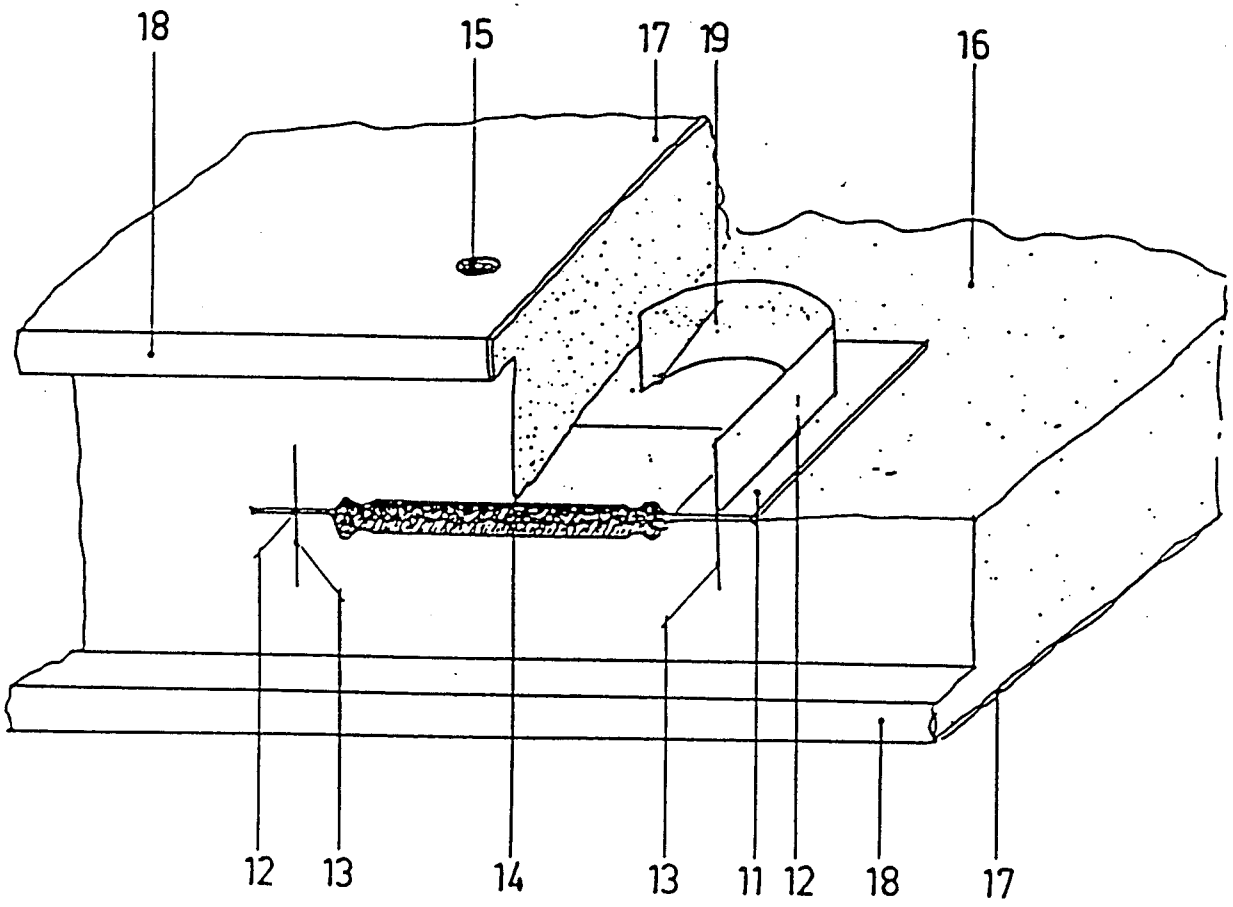

In FIG. 3, 14 designates a lock-half of known type for panels. These locks consist essentially of a hook in one half of the lock and a pin in the other half of the lock, the hook engaging the pin by a rotary motion given to the hook via a key inserted through a small hole 15 in the panel. The parts of the lock 14 not being part of the invention are not shown or described.

The integral lock 14 and the plate 11 are integrated in one unit, consisting of two halves of pressed metal sheets. The plate 11 together with the lock 14 have been inserted into a machined cavity and slot in the polyurethane foam core of a panel, of which only a part has been shown. For clarity some of this part has been broken away to show the details of the fastening means. The foam core of the panel is designated by reference numeral 16 and the core is enclosed by two metal sheets 17, one on each side and each provided with an angled edge gripping over the edge of the foam core, which is recessed to give a groove for a corresponding protrusion on an adjacent panel when mounted so that a well protected guiding joint is established.

If the plate 11 is sufficiently thin, it is only necessary to provide a cavity for the lock 14 whereas the plate 11 can itself cut its way through the porous polyurethane foam 16. When the lock 14 and plate 11 have been inserted to the intended depth, which essentially leaves the outer edge of lock 14 and plate 11 flush with the surface of the foam material. Two metal strips 13 are pushed into slots 12 in the plate 11. These slots first extend along a straight line, right angled relative the front edge of plate and lock and then, when having passed the lock 14, the slot continues in an inwards turned half-circle. The metal strips 13 cut their way into the foam when inserted into the slot and consequently cut an indentical path in the foam, giving the final position shown in the drawing. When the strips have been inserted, the friction between the strip and the foam will keep the strip in its inserted position, and as is apparent from FIG. 3 the strip gives the plate 11 a very good grip in the foam material 16. Due to the curvature of the strip the latter will become very stiff at its inner end, resulting in a very unyielding grip in a direction tending to pull out the plate 11 in the same direction as it was inserted. In the inner end the strips 13 are provided with lugs 19 of which only one is shown. These lugs are arranged on each side of the plate 11 so as to centralize the inner end of the strip. This is not an absolutely necessary feature of the invention, but it prevents the strip from sliding out of grip with the slot when it is pushed into slot and material. Of course further guiding lugs 19 can be provided in the strip but this is not necessary since the tool pressing the strips 13 into slot and foam material can take care of the guiding in the outer end. In this shown embodiment the arrangement of the slots 12 and the metal strips 13 is symmetrical but of course also nonsymmetrical embodiments are possible and it is also possible to allow the different strips to have different radius for the slots at the inner end and they may also be situated at different depths from the front of the lock 14.

The friction between the foam material and the metal blade or strip 13 is quite sufficient to ensure that the blade, when once inserted, remains in position.

If it should be discovered that the locks in a panel must have their positions altered, e.g. because the panels are placed on an uneven support, this can easily be done by gripping the external end of the strips 13 with a pair of pliers and pulling them out. Lock and plate 11 are thereafter possible to withdraw, a new cavity for the lock 14 can be made and lock and strips 13 can once again be inserted in their new place.

It should again be pointed out that the invention is not limited to the above described examples and in particular it should be pointed out that even though only metal strips curving in one direction have been shown, it is of course also possible to allow the metal strip to curve first in one and then in another direction, still resulting in a very stiff shape. Furthermore the fastening means of the invention may be symmetric or not. In fact a fastening means can be provided with metal strips which extend into different depths into the foam. Furthermore since, as is the case with panels, the most important is that forces can be taken up in the direction of the insertion of the plate the fastening means of the invention can be so made that the length of the metal strip only corresponds to the length of the curved section and that special tools are extended into the foam material or the guiding slot pushing the metal strip to its working position or the metal strip may in its rear end be narrower. Furthermore the invention is not limited to the particular use of metal even though this is most convenient.

As has been described above the use of curved slot sections or perhaps one should say guide sections (since the guide not necessarily have to be in the shape of a slot), enables the use of a very thin blade or strip due to the rigidity of curved surfaces. If essentially straight guide sections are to be used, one must (in order to compensate for the loss of rigidity) make the corresponding strips or blades thicker or in other ways provided with a greater stiffness. In order to allow such a blade to follow for instance an angled part the blade or strip can be provided with transversal cuts. The strips or blades are preferably flexible but may of course be deformable instead.

Within the scope of the invention further developments and appliances are of course possible for the skilled artisan.

I claim:

1. Fastening means for use in porous granulous or other easily penetratable materials, comprising a first guide element including a flat plate and a second bendable bladelike material-gripping element having two opposite sides, the guide element having at least one partially curved guide slot engageable with and guiding both sides of the second material-gripping element along the entire gripping length of the gripping element, the guide element being insertable in the penetratable material and thereafter the gripping element being inserted along the guide element.

2. Fastening means as in claim 1, characterized in that it includes several second elements movable along respective guide slots to grip into the material.

3. Fastening means as in claim 1, characterized in that the second element is retained in the slot and in the easily penetrated materials by friction only.

4. Fastening means as in claim 1, characterized in that the curved part of the guide essentially is symmetrical relative to a line parallel to that of an expected force on the first element to give a balanced grip.

5. Fastening means for use in porous granulous or otherwise easily penetratable materials comprising two elements, the first providing a guide for a second gripping element, characterized in that the first element is a flat plate and is provided with a curved guide slot for the second element, the second element being flexible or a very easily bendable bladelike element;

the first element enclosing and guiding the second bladelike flexible element on both sides of the second element over the entire length of the second element.

6. Fastening means as in claim 5, wherein the second element is retained in the slot and the penetratable material by friction only.

7. Fastening means as in claim 5, characterized in that it includes several second elements movable along respective guide slots.

8. Fastening means as in claim 5, characterized in that the guide, and thus the second element on insertion over a length where a greatest force is expected is curved.

9. Fastening means as in claim 5, characterized in that the curved part of the guide essentially is symmetrical relative to a line parallel to that of an expected force on the first element to give a balanced grip.

10. Fastening means for use in porous granular or other easily penetratable material comprising: a guide element in the form of a flat plate having opposite faces and at least one guide slot which is open along said opposite faces and which has an open end at an edge of the plate, the slot being at least partially curved along its length, and a material-gripping element in the form of a blade which has a width greater than the thickness of the plate and which is insertable into the slot, the blade having opposite sides which are engaged by and guided by opposite edges of the slot along the entire length of the blade when the blade is inserted into the slot and the blade being deformed by the edges of the slot so as to correspond to the shape of the slot.

* * * * *